United States Patent [19]

Svending et al.

[11] 4,385,961

[45] May 31, 1983

[54] PAPERMAKING

[75] Inventors: Per J. Svending, Gothenburg; Per G. Båtelson, Lilla Edet; Hans E. Johansson, Kungälv; Hans M. Larsson, Gothenburg, all of Sweden

[73] Assignee: EKA Aktiebolag, Surte, Sweden

[21] Appl. No.: 238,645

[22] Filed: Feb. 26, 1981

[51] Int. Cl.[3] ..... D21H 3/28; D21H 3/66

[52] U.S. Cl. ..... 162/175; 162/181.6; 162/183

[58] Field of Search ..... 162/181.6, 175, 183, 162/190, 191, 199

[56] References Cited

U.S. PATENT DOCUMENTS

| | | | |
|---|---|---|---|
| 2,647,158 | 7/1953 | Booth | 162/181.6 |
| 2,865,743 | 12/1958 | Weisgerber | 162/181.6 |
| 3,224,927 | 12/1965 | Brown et al. | 162/181.6 |
| 3,227,607 | 1/1966 | Mays et al. | 162/181.6 |
| 3,721,575 | 3/1973 | Jarowenko et al. | 162/175 |
| 3,737,370 | 6/1973 | Jarowenko et al. | 162/175 |

OTHER PUBLICATIONS

Casey, *Pulp and Paper*, vol. II, (1960), pp. 746, 846, 1014, 1178, 1179.

*Primary Examiner*—Peter Chin
*Attorney, Agent, or Firm*—Luedeka & Neely

[57] ABSTRACT

A papermaking process in which an aqueous papermaking stock containing a cellulosic pulp is formed and dried. The stock includes a binder comprising colloidal silicic acid, and cationic starch which is added to the stock before the sheet is formed. The manner of addition involves first adding and intermixing in the stock a portion of the colloidal silicic acid and then the cationic starch and, after an agglomerate has formed, adding and intermixing the remainder of the colloidal silicic acid prior to the formation of the sheet. The method results in improved sheet properties and improved retention of filler and fines on the wire.

5 Claims, 2 Drawing Figures

PAPERMAKING

The present invention relates generally to papermaking processes and, more particularly, to the use of a binder in a papermaking process, the binder comprising a complex of cationic starch and colloidal silicic acid to produce a paper having increased strength and other characteristics. Such a binder, in addition, also effects highly improved levels of retention of added mineral materials as well as papermaking fines.

At the present time, the papermaking industry is plagued with a number of serious problems. First, the price of cellulosic pulp has escalated materially and high quality pulp is in relatively short supply. Second, various problems including the problems inherent in the disposal of papermaking wastes and the ecological requirements of various governmental bodies have markedly increased the cost of papermaking. Finally, the cost of the energy required to make paper has increased materially. As a result, the industry and its customers are faced with two choices: either pay the higher costs or materially decrease the amounts and/or quality of the cellulosic fibers with a consequential loss of quality in the finished paper product.

The industry has made various attempts to reduce the cost of the paper products. One approach that has been employed involves the addition of clay and other mineral fillers in the papermaking process to replace fiber but such additions have been found to reduce the strength and other characteristics of the resulting paper to a degree which is unsatisfactory. Also, the addition of such mineral filler results in poor retention of the filler material, e.g. they pass through the wire to the extent that the level of filler materials builds up in the white water with the result that the clean up of white water and the disposal of the material becomes a serious problem. Various binders have been employed in an attempt to alleviate the retention problem but their use has not been entirely satisfactory.

Attempts have also been made to use types of pulp which are less expensive and of lower quality, but this, of course, results in a reduction in the characteristics of the paper and often results in excessive fines which are not retained in the papermaking process with the consequent white water disposal problems.

In application Ser. No. 06/238,635 filed in the U.S. Patent Office contemporaneously with this application and assigned to the assignee of this invention and on which we are co-inventors, there is disclosed a binder system and method which produce improved properties in paper and which will permit the use of minimum amounts of fiber to attain strengths and other properties which are required. In general, the system of that invention includes the use of a binder complex which involves two components, i.e. colloidal silicic acid and cationic starch. The weight ratio between the cationic starch and the $SiO_2$ in the colloidal silicic acid is greater than one and less than about 25. The two components are provided in the stock prior to formation of the paper product on the papermaking machine. It has been found that, after drying, the sheet has greatly enhanced strength characteristics. Also, it has been found that when mineral fillers such as clay, chalk and the like are employed in the stock, these mineral fillers are efficiently retained in the sheet and further do not have the degree of deleterious effect upon the strength of the sheet that will be observed when the binder system is not employed.

While the mechanism that occurs in the stock and during paper formation and drying in the presence of the binder is not entirely understood, it is believed that the cationic starch and the anionic colloidal silicic acid form a complex agglomerate which is bound together by the anionic colloidal silicic acid, and that the cationic starch becomes associated with the surface of the mineral filler material whose surface is either totally or partially anionic. The cationic starch also becomes associated with the cellulosic fiber and the fines, both of which are anionic. Upon drying, the association between the agglomerate and the cellulosic fibers provides extensive hydrogen bonding. This theory is supported in part by the fact that as the Zeta potential in the anionic stock moves towards zero when employing the binder complex of the invention both the strength characteristics and the retention improve.

The principal object of this invention is to further enhance the effect of the binder complex disclosed in application Ser. No. 06/238,635. Other objects and advantages of the invention will become known by reference to the following description and the appended drawings in which.

Figure 1:
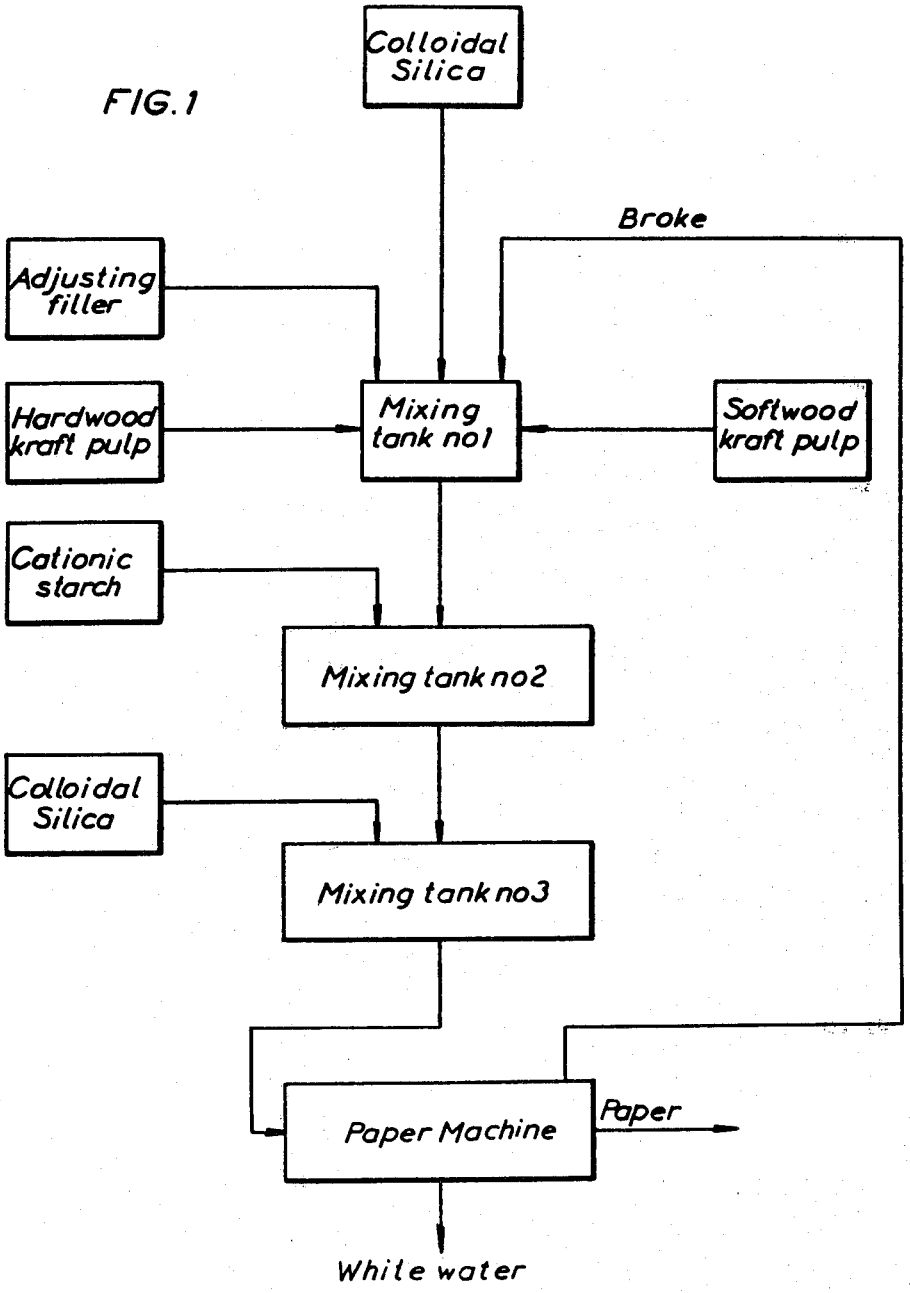
FIG. 1 is a flow diagram of a papermaking process embodying various of the features of the invention.

We have discovered that when a binder of the type disclosed in copending application Ser. No. 06/238,635 is employed, the effect of the binder system may be enhanced by adding the colloidal silicic acid component in several increments, i.e. a portion of the colloidal silicic acid is admixed with the pulp and the mineral filler when present, then the cationic starch is added and thereafter when a complex agglomerate of pulp, filler (if any), silicic acid and starch is formed and before the stock is fed to the head box of the papermaking machine the remaining portion of the colloidal silicic acid is admixed with the stock containing the complex agglomerate. This procedure of supplying the colloidal silicic acid in two or more steps results in certain improvements in strength and other characteristics, but the most striking improvement is the increase in retention of filler and papermaking fines. The reason for these improvements is not entirely understood but it is believed that they result from the production of complex filler-fiber-binder agglomerates, which are more stable, i.e. that the later addition of the colloidal silicic acid causes the agglomerates initially formed to bond together to form even more stable agglomerates which are less sensitive to mechanical and other forces during the formation of the paper.

Based upon the work that has been done to date, the principles of this invention are believed applicable in the manufacture of all grades and types of paper products. For example, printing grades, including newsprint, tissue, paper board and the like.

It has been found that the greatest improvements are observed when the binder is employed with chemical pulps, e.g. sulfate and sulfite pulps from both hard and soft wood. Lesser but highly significant improvements occur with thermo-mechanical and mechanical pulps. It has been noted that the presence of excessive amounts of lignin in ground wood pulps seems to interfere with the efficiency of the binder so that such pulps may require either a greater proportion of binder or the inclusion of a greater proportion of other pulp of low lignin content to achieve the desired result. (As used herein, the terms "cellulosic pulp" and "cellulosic fiber" refer to chemical, thermo-mechanical and mechanical or ground wood pulp and the fibers contained therein.)

The presence of cellulosic fibers is essential to obtain certain of the improved results of the invention which occur because of the interaction or association of agglomerate and the cellulosic fibers. Preferably, the finished paper should contain over 50% cellulosic fiber but paper containing lesser amounts of cellulosic fibers may be produced which have greatly improved properties as compared to paper made from similar stocks not employing the binder agglomerate described herein.

Mineral filler material which can be employed includes any of the common mineral fillers which have a surface which is at least partially anionic in character. Mineral fillers such as kaolin (china clay), bentonite, titanium dioxide, chalk, and talc all may be employed satisfactorily. (The term "mineral fillers" as used herein includes in addition to the foregoing materials, wollastonite and glass fibers.) When the binder complex disclosed herein is employed, the mineral fillers will be substantially retained in the finished product and the paper produce will not have its strength degraded to the degree observed when the binder is not employed.

The mineral filler is normally added in the form of an aqueous slurry in the usual concentrations employed for such fillers.

As pointed out above, the binder comprises a combination of colloidal silicic acid and cationic starch. The colloidal silicic acid may take various forms, for example, it may be in the form of polysilicic acid or colloidal silica sols although best results are obtained through the use of colloidal silica sols.

Polysilicic acid can be made by reacting water glass with sulfuric acid by known procedures to provide molecular weights (as $SiO_2$) up to about 100,000. However, the resulting polysilicic acid is unstable and difficult to use and presents a problem in that the presence of sodium sulfate causes corrosion and other problems in papermaking and white water disposal. The sodium sulfate may be removed by ion exchange through the use of known methods but the resulting polysilicic acid is unstable and without stabilization will deteriorate on storage. Salt-free polysilicic acid may also be produced by direct ion exchange of diluted water glass.

While substantial improvements are observed in both strength and retention with a binder containing polysilicic acid and cationic starch, superior results are obtained through the use with the cationic starch of colloidal silica in the form of a sol containing between about 2–60% by weight of $SiO_2$ and preferably about 4–30% $SiO_2$ by weight.

The colloidal silica in the sol should desirably have a surface area of from about 50 to 1000 $m^2/g$ and preferably a surface area from about 200 to 1000 $m^2/g$ with best results being observed when the surface area is between about 300 to 700 $m^2/g$. The silica sol is stabilized with an alkali having a molar ratio of $SiO_2$ to $M_2O$ of from 10:1 to 300:1 and preferably a ratio of from 15:1 to 100:1 (M is an ion selected from the group consisting of Na, K, Li and $NH_4$). It has been determined that the size of the colloidal silica particles should be under 20 nm and preferably should have an average size ranging from about 10 down to 1 nm. (A colloidal silica particle having a surface area of about 500 $m^2/g$ involves an average particle size of about 5.5 nm).

In essence, it is preferably sought to employ a silica sol having colloidal silica particles which have a maximum active surface and a well defined small size generally averaging 4–9 nm.

Silica sols meeting the above specifications are commercially available from various sources including Nalco Chemical Company, Du Pont & de Nemours Corporation and the assignee of this invention.

The cationic starch which is employed in the binder may be made from starches derived from any of the common starch producing materials, e.g. corn starch, wheat starch, potato starch, rice starch, etc. As is well known, a starch is made cationic by ammonium group substitution by known procedures. Best results have been obtained when the degree of substitution (d.s.) is between about 0.01 and 0.05 and preferably between about 0.02 and 0.04, and most preferably over about 0.025 and less than about 0.04. While a wide variety of ammonium compounds, preferably quaternary, are employed in making cationized starches for use in our binder, we prefer to employ a cationized starch which was prepared by treating the base starch with either 3-chloro-2-hydroxypropyl-trimethyl ammonium chloride or 2,3-epoxypropyl-trimethyl ammonium chloride to obtain a cationized starch having 0.02–0.04 d.s.

In the papermaking process the binder is added to the papermaking stock prior to the time that the paper product is formed on the papermaking machine. In the initial addition, a portion of the colloidal silicic acid component and the cationic starch may be mixed together to form an aqueous slurry of the silica-cationic starch complex which then can be added to and thoroughly mixed with the papermaking stock. However, this procedure does not provide maximized results. It is preferable that the initial silica-cationic starch complex is formed in situ in the papermaking stock. This can be accomplished by adding the initial portion of the colloidal silicic acid component in the form of an aqueous sol and the cationic starch in the form of an aqueous solution separately to the stock in a mixing tank or at a point in the system where there is adequate agitation so that the two components are dispersed with the papermaking components so that they interact with each other, and with the papermaking components at the same time.

Even better results are obtained if the initial portion of the colloidal silicic acid component is added to a portion of the stock and thoroughly mixed therewith after which the make-up of the stock is completed and the cationic starch component is added and thoroughly mixed with the stock prior to the formation of the paper product.

In the event that a mineral filler is to be added to the stock it has been found preferable to slurry the mineral filler in water with the initial portion of the colloidal silicic acid component and then to introduce the filler-colloidal silicic acid component slurry into a mixing device where it is incorporated into the stock along with the pulp and cationic starch.

Thereafter, the final portion or portions of the colloidal silicic acid component are thoroughly mixed with the stock after the initial agglomerate is formed and prior to or at the time the stock is conducted into the head box. The initial addition of the colloidal silicic acid should comprise about 20 to 90 percent of the total amount to be added and then, after the initial agglomerate is formed, the remainder should be added before the sheet is formed. Preferably, the initial addition should comprise 30–80% of the colloidal silicic acid component.

It has been found that in a papermaking process employing the binder complex described herein, the pH of the stock is not unduly critical and may range from a pH of from 4 to 9. However, pH ranges higher than 9 and lower than 4 are undesirable. Also, other paper chemicals such as sizing agents, alum, and the like may be employed but care should be taken that the level of these agents is not great enough to interfere with the formation of the silica-cationic starch agglomerate and that the level of the agent in recirculating white water does not become excessive so as to interfere with the formation of the binder agglomerate. Therefore, it is usually preferred to add the agent at a point in the system after the agglomerate is formed.

As pointed out above, the ratio of cationic starch to the total colloidal silicic acid component should be between 1:1 and 25:1 by weight. Preferably, the ratio is between 1.5:1 and 10:1 and most preferably between 1.5:1 and 4.5:1.

The amount of binder to be employed varies with the effect desired and the characteristics of the particular components which are selected in making up the binder. For example, if the binder includes polysilicic acid as the colloidal silicic acid component, more binder will be required than if the colloidal silicic acid component is colloidal silica sol having a surface area of 300 to 700 $m^2/g$. Similarly, if the cationic starch, for example, has a d.s. of 0.025 as compared to a d.s. of 0.030, more binder will be required assuming the colloidal silicic acid component is unchanged.

In general, when the stock does not contain a mineral filler the level of binder may range from 0.1 to 15% by weight and preferably from 1 to 15% by weight based upon the weight of the cellulosic fiber. As pointed out above, the effectiveness of the binder is greater with chemical pulps so that less binder will be required with these pulps to obtain a given effect than other types. In the event that a mineral filler is employed the amount of binder may be based on the weight of the filler material and may range from 0.5 to 25% by weight and usually between 2.5 to 15% by weight of the filler.

The following are specific examples of a process embodying features of the invention.

EXAMPLE 1

A commercial trial run was made making a coated, off-set, super calendered printing paper having a grammage of 85 $g/m^2$. The machine employed was a twin wire Beloit "Bel-Baie" machine having a capacity of about 10,000 kg/hour at a speed of about 600 m/min. The coating was accomplished "on-line" with 10 $g/m^2$ of calcium carbonate applied to each side of the sheet. The cellulosic fiber comprised 70% sulfate hardwood and 30% sulfate softwood pulp both of which were fully bleached. The pH of the white water was about 8.5.

In the operation of the machine which was employed, the quality requirements for the paper produced by it were very rigid. As a result, in normal operation, a high proportion of the finished coated paper, about 25%, is classified as "broke." Broke, is unsatisfactory paper which is recycled into the stock and is reformed into a paper web. As a result, the stock to the machine head box contains a large proportion of filler in the form of reslurried coating from the broke. The proportion of the broke is often as high as 50% of the solids in the total stock.

The presence of the additional filler from the broke constitutes a serious problem in normal operation of the machine since its retention on the papermaking wire is extremely poor and most of it finds its way into the white water and eventually into the sewer. Also, since the amount of broke always varies, the filler content in the base sheet varies causing uneven sheet properties with the result that there are numerous breaks in the paper web during production with attendant loss of production.

FIG. 1 is a flow diagram indicating the general operation which was employed in the run of this example employing various of the teachings of the invention.

In Mixing Tank No. 1, the two types of bleached pulp which were typically used in the plant, i.e. the 70% sulfate hardwood and 30% sulfate softwood pulp, both fully bleached, were mixed together with the slurried broke. In order to compensate for varying amounts of filler in the stock caused by differing amounts of broke, arrangements were made to add a desired amount of extra filler (calcium carbonate). At this point, the amount of extra filler added was dependent upon the ash content which was measured continuously on line in the base sheet and enough calcium carbonate filler was added to maintain the level of ash in the finished paper base sheet at 15% by weight of dry paper.

In addition, in Mixing Tank No. 1, there was added in the form of an aqueous solution of colloidal silica containing 15% by weight $SiO_2$, in an amount equivalent to 1.7 kg of $SiO_2$ per metric ton of dry base sheet (prior to coating). The colloidal silica sol was stabilized with alkali with a molar ratio of $SiO_2$:$Na_2O$ of 45:1. The silica had a particle size in the range of from about 5–7 nm and a surface area of approximately 500 $m^2/g$.

The materials were thoroughly mixed and were conducted to Mixing Tank No. 2 were cationic starch was added to the stock, in an amount equal to 10.2 kg of cationic starch per metric ton of dry base sheet. The cationic starch was prepared by treating potato starch with 3-chloro-2-hydroxypropyl-trimethyl-ammonium chloride to provide a degree of substitution (d.s.) in the starch of 0.03. It was dispersed in cold water at a concentration of about 4% by weight, heated for 30 minutes at about 90° C., diluted with cold water to a concentration of about 2% by weight and then added to Mixing Tank No. 2.

After the cationic starch was thoroughly intermixed the stock was conducted to Mixing Tank No. 3 wherein a second increment of colloidal silica sol, of the type described above, was added to the stock in an amount equal to 2.1 kg per metric ton of dry base sheet.

From Mixing Tank No. 3 the stock was fed into the head box of the paper machine which was operated at normal speeds to form the base sheet which was subsequently dried, coated with a coating slip containing calcium carbonate and calendered in the same manner as before.

Figure 2:
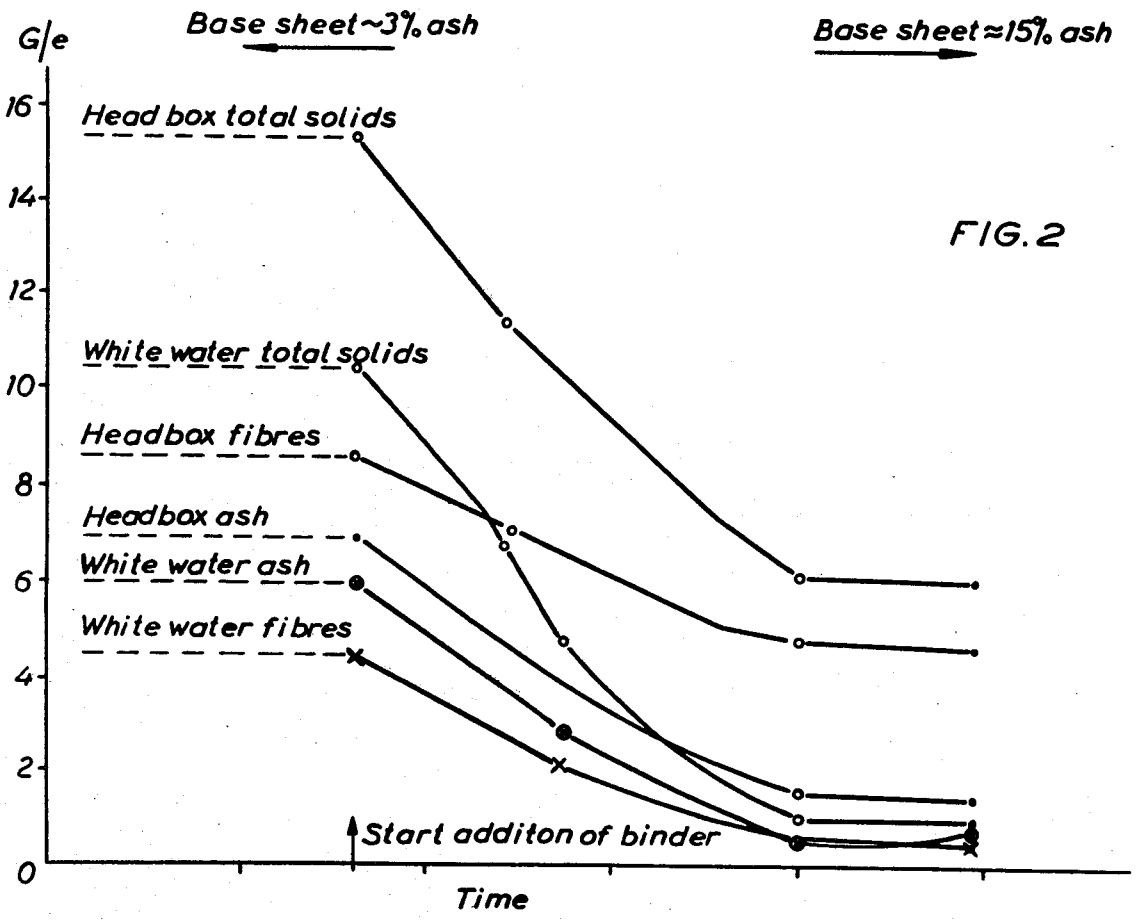
FIG. 2 is a chart showing a test run on a papermaking machine, the process employed embodying various of the features of the invention.

FIG. 2 graphically illustrates the effect of the addition of the colloidal silica and cationic starch, as set forth above. The left hand side of the chart shows the condition of the stock of the white water in the commercial run prior to the addition of the colloidal silica and the cationic starch as outlined above. As will be noted, the total solids in the stock at the former or head box is approximately 15.5 g/l, of which approximately 8.5 g/l is fiber and 7 g/l is ash. The base sheet produced from this stock contained approximately 3 percent ash.

As appears from FIG. 2, the white water in the commercial run before the addition of the colloidal silica and cationic starch, contained approximately 10.5 g/l of solids; 6.0 g/l ash; and 4.5 g/l fiber.

The dramatic effect of the addition of the colloidal silica and cationic starch as outlined above, is shown on the right hand side of FIG. 2 where the total solids in the head box decreased to approximately 6 g/l; slightly less than 5 g/l fiber; and about 1.5 g/l ash. The total solids in the white water dropped to about 1 g/l; about 0.5 g/l fiber; and about 0.5 g/l ash. The base sheet contained approximately 15 percent ash and, the machine breaks during operation were substantially less than in the commercial operation where the sheet contained only 3 percent ash.

Test results showed that even though the finished base sheet made, as outlined above, had an increased amount of filler, i.e. from about 3 percent to about 15 percent which normally degrades the properties of the sheet, the additional filler did not materially decrease the strength properties or printing properties of the paper. To the contrary, certain properties were increased markedly. For example, Z-strength or Internal bond strength measured by the Scott-bond method increased by 85 percent at the 15 percent filler level as compared to the 3 percent filler level in the commercial runs. The IGT (Instituut Voor Grafische Techniek, Amsterdam) surface picking resistance increased by 40 percent and the bursting strength increased by 40 percent.

During the trial, which extended over a several week period, it was found that it was possible to add much more broke to the stock than before. At one period extending for about 16 hours, the entire stock was broke. Further, with the addition of additional filler material it was found that it was possible to maintain 15 percent filler in the base sheet over a two-week period and that the resulting even level of ash permitted an increase in the productivity of the paper machine due to fewer breaks and a saving of fiber.

It was also found that the coupling of increased retention and decreased head box consistency resulted in a marked improvement in the drainage rate of the stock on the wire. This, of course, means that an increase in the machine speed is made possible which will even further enhance the productivity.

The retention of fibers and fines on the wire in the papermaking machine was also greatly improved. Retention percentage is determined by dividing the difference between the concentration of total solids in the head box and the concentration of total solids in the white water by the concentration of total solids in the head box and multiplying by 100. Thus, on the commercial run preceding the addition of the silica sol and cationic starch as outlined above, the percentage of retention was (15.5–10.5)/15.5×100 or 32%. As a result of the use of our process the percentage of retention increased to about $$83\% \left( \frac{6.0 - 1.0}{6.0} \times 100 \right).$$

This high level of retention simplified white water clean up and disposal.

EXAMPLE II

To further demonstrate the advantages of the two-step operation, extended runs were made under various conditions on the commercial machine described in Example I. The results of these runs are set forth in tabular form in Table I.

Run 1 reflects the average operation of the machine of Example I in making coated, supercalendered printing paper over an extended period of time. The cellulosic fiber comprised 70% sulfate hardwood and 30% sulfate softwood, both fully bleached. Normal amounts of broke were recycled. The base sheet was coated with 10 g/m$^2$ of calcium carbonate per side.

Run 2 reflects the average operation of the machine of Example I over an extended period in making coated, supercalendered printing paper in which the same fiber was employed and normal amounts of broke were recycled in which the colloidal silicic acid employed was a 15% aqueous sol having the specifications set forth in Example I. It was added to Mixing Tank No. 1 at a level of 3.8 kg of $SiO_2$ per metric ton of dry base sheet. Cationic starch was added in Mixing Tank No. 2 at a level of 11.8 kg of cationic starch per metric ton of dry base sheet, the cationic starch having the specification as set forth in Example I and the method of addition was as set forth in Example I. No additions were made in Mixing Tank No. 3. The base sheet after drying was coated on each side with 10 g/m$^2$ of calcium carbonate.

Run 3 followed the procedure of Run 2 except that the addition of the silica sol was added in two increments. There was added in Mixing Tank No. 1, 2.9 kg of $SiO_2$ per metric ton of dry base sheet. In Mixing Tank No. 2 the cationic starch was added at a level of 13.7 kg of cationic starch per metric ton of dry base sheet. In Mixing Tank No. 3 a second addition of the silica sol was added at a level of 1.5 kg of $SiO_2$ per metric ton of dry base sheet.

The results are tabulated below:

TABLE

| | RUN 1 | RUN 2 | RUN 3 |
|---|---|---|---|
| Grammage g/m$^2$ | 85 | 85 | 85 |
| Ash content % | 17 | 28 | 24 |
| Tensile index machine direction Nm/g | 66.2 | 64.2 | 64.5 |
| cross direction Nm/g | 21.7 | 22.5 | 26.8 |
| Burst Strength kPa | 214 | 294 | 310 |
| Surface picking resistance IGT | | | |
| top side | 73.4 | 92 | 112 |
| wire side | 68.7 | 83 | 112 |
| Internal bond strength Scott bond J/m$^2$ | 225 | 506 | 525 |
| Concentration at head box g/l solids | 15.5 | 10.1 | 6.3 |
| White water concentration g/l solids | 10.5 | 5.2 | 1.2 |
| Retention % | 32.3 | 48.5 | 81.0 |

As will be seen from the foregoing, the use of a colloidal silicic acid-cationic starch binder complex in which the colloidal silicic acid component is added incrementally, a portion being added after the initial agglomerate is formed, makes possible substantial economics in the papermaking process as well as an improved paper product. Also, a mineral filler may be employed in much larger proportions than heretofore used while maintaining or even improving the characteristics and properties of the sheet. Some of the properties of a sheet containing filler are enhanced.

In addition, the use of the binder system results in increased retention of both minerals and fines so that white water problems are minimized.

Further, because of the ability to reduce the basis weight of a sheet or to increase the mineral content, it is possible to reduce the energy required to dry the paper and to pulp the wood fibers since less fiber can be employed. Also, the increased rate of drainage and the higher retention on the wire make possible higher machine speeds.

While a preferred embodiment has been shown and described it will be understood that there is no intent to limit the invention by such disclosure, but rather it is intended to cover all modifications and alternate constructions falling within the spirit and scope of the invention as defined in the appended claims.

We claim:

1. In a papermaking process in which an aqueous papermaking stock containing a cellulosic pulp is formed into a sheet and dried, said sheet comprising over 50% cellulosic fiber, the stock including a binder comprising colloidal silicic acid having an average particle size of less than 20 nm, and cationic starch having a degree of substitution of between 0.01 and 0.05, the weight ratio of cationic starch to $SiO_2$ being between 1:1 and 25:1, the weight of solids in the binder being between 0.1–15% by weight of said pulp the improvement which comprises intermixing in the stock first a portion of the colloidal silicic acid and then the cationic starch and after an agglomerate has formed, adding and intermixing the remainder of the colloidal silicic acid in the stock prior to the formation of the sheet, said first portion of colloidal silicic acid comprising 20–90% of the total colloidal silicic acid added.

2. In a papermaking process in which an aqueous papermaking stock containing a cellulosic pulp is formed into a sheet and dried, said sheet comprising over 50% cellulosic fiber, the stock including a binder comprising a colloidal silicic acid sol having silica particles having a surface area of from about 50 to 1000 $m^2/g$ and cationic starch having a degree of substitution of between 0.02 and 0.04, the weight ratio of cationic starch to $SiO_2$ being between 1.5:1 and 10:1, the weight of solids in the binder being between about 0.1–15% of the weight of the pulp, the improvement which comprises intermixing in the stock first a portion of the colloidal silicic acid and then the cationic starch and, after an agglomerate has formed, adding and intermixing the remainder of the colloidal silicic acid in the stock prior to the formation of the sheet said first portion of colloidal silicic acid sol comprising 20–90% of the total colloidal silicic acid sol added.

3. In a papermaking process in which an aqueous papermaking stock containing a cellulosic pulp is formed into a sheet and dried, said sheet comprising over 50% cellulosic fiber, the stock including a binder comprising a colloidal silicic acid sol having silica particles having a surface area of from about 300 to 700 $m^2/g$ and cationic starch having a degree of substitution of between 0.02 and 0.04, the weight ratio of cationic starch to $SiO_2$ being between 1.5:1 and 10:1, the weight of solids in the binder being between about 1.0–15% of the weight of the pulp, the improvement which comprises intermixing in the stock first a portion of the colloidal silicic acid and then the cationic starch and, after an agglomerate has formed, adding and intermixing the remainder of the colloidal silicic acid in the stock prior to the formation of the sheet said first portion of colloidal silicic acid sol comprising 20–90% of the total colloidal silicic acid sol added.

4. In a papermaking process in which an aqueous papermaking stock containing a cellulosic pulp is formed into a sheet and dried, said sheet comprising over 50% cellulosic fiber, the stock including a binder comprising a colloidal silicic acid sol having silica particles having a surface area of from about 300 to 700 $m^2/g$ and cationic starch having a degree of substitution of between 0.02 and 0.04, the weight ratio of cationic starch to $SiO_2$ being between 1.5:1 and 4.5:1, the weight of solids in the binder being between about 1.0–15% of the weight of the pulp, the improvement which comprises intermixing in the stock first a portion of the colloidal silicic acid and then the cationic starch and, after an agglomerate has formed, adding and intermixing the remainder of the colloidal silicic acid in the stock prior to the formation of the sheet said first portion of colloidal silicic acid sol comprising 20–90% of the total colloidal silicic acid sol added.

5. The process of any one of claims 1, 2, 3, and 4 wherein between about 30 and about 80 percent of the colloidal silic acid is added to the stock to form an agglomerate and the remaining portion of the colloidal silicic acid is added after the formation of the agglomerate.

* * * * *